US007926240B1

(12) United States Patent
Jacovitz

(10) Patent No.: US 7,926,240 B1
(45) Date of Patent: Apr. 19, 2011

(54) EARTHQUAKE RESISTANT BUILDING CONSTRUCTION AND METHOD

(76) Inventor: Bernard Jacovitz, Boca Raton, FL (US)

( * ) Notice: Subject to any disclaimer, the term of this patent is extended or adjusted under 35 U.S.C. 154(b) by 0 days.

(21) Appl. No.: 12/798,429

(22) Filed: Jun. 22, 2010

(51) Int. Cl.
*E04D 1/00* (2006.01)

(52) U.S. Cl. ..... 52/653.2; 52/167.7; 52/169.9; 52/294; 52/299; 52/745.19

(58) Field of Classification Search ..... 52/167.4, 52/167.7, 169.9, 261, 274, 294–295, 299, 52/653.1, 653.2, 293.1, 293.3, 745.15, 745.19
See application file for complete search history.

(56) References Cited

U.S. PATENT DOCUMENTS

| | | | | | |
|---|---|---|---|---|---|
| 1,622,071 | A * | 3/1927 | Urban, Sr. | 52/274 |
| 1,671,462 | A * | 5/1928 | Bemis | 52/236.5 |
| 2,427,937 | A * | 9/1947 | Willson | 52/198 |
| 2,471,675 | A * | 5/1949 | De Jongh | 52/86 |
| 3,105,252 | A * | 10/1963 | Milk | 14/73.5 |
| 3,243,236 | A * | 3/1966 | Graham | 384/36 |
| 3,424,178 | A * | 1/1969 | Yazaki | 135/157 |
| 3,618,280 | A * | 11/1971 | Langston | 52/309.15 |
| 3,657,849 | A * | 4/1972 | Garton | 52/91.1 |
| 3,893,271 | A * | 7/1975 | Kotlarz | 52/168 |
| 4,766,712 | A * | 8/1988 | Hale | 52/645 |
| 5,598,668 | A * | 2/1997 | Isom | 52/86 |
| 5,660,002 | A * | 8/1997 | Lashinger | 52/63 |
| 5,930,971 | A * | 8/1999 | Etheridge | 52/646 |
| 5,966,890 | A * | 10/1999 | Inman | 52/653.2 |
| 6,279,289 | B1 * | 8/2001 | Soder et al. | 52/656.9 |
| 2001/0023563 | A1 * | 9/2001 | Phillips | 52/292 |
| 2001/0042351 | A1 * | 11/2001 | Keil | 52/653.2 |
| 2003/0024174 | A1 * | 2/2003 | Bonds et al. | 52/79.1 |
| 2009/0056253 | A1 * | 3/2009 | Davis | 52/292 |

FOREIGN PATENT DOCUMENTS

JP 01304226 A * 12/1989

* cited by examiner

*Primary Examiner* — Brian E Glessner
*Assistant Examiner* — Adriana Figueroa

(57) ABSTRACT

Construction systems and methods are described for building structures including homes that can withstand vibration and earth movement caused by earthquakes. The construction system uses about 8-inch corrugated round steel pipes to create floor framing, wall framing, and ceiling framing that is resistant to destruction caused by earth movement and vibrations. The floor framing and wall framing can be connected together at right angles and supported by a foundation that features wood pilings with concrete caps. The plurality of pipes of the floor framing, wall framing, and ceiling framing can be connected together by welding, screws, or other fasteners to assemble the structure. Finished floor, material, and ceiling materials can be fastened to the frames to complete the structure.

16 Claims, 3 Drawing Sheets

EARTHQUAKE RESISTANT BUILDING CONSTRUCTION AND METHOD

FIELD OF THE INVENTION

The invention relates to building construction. More particularly, the invention relates to building construction and construction methods that are resistant to damage caused by earthquakes.

BACKGROUND

Conventional home construction uses 8-inch thick masonry walls or wood frame walls and concrete or wooden floors. Such conventional construction produces a strong, inflexible structure that cracks, breaks, and falls apart when earthquakes occur.

A need exists for flexible home and building construction having framing that moves but retains or returns to its original shape and position after earth movement has occurred.

SUMMARY

The invention features construction systems and methods for building structures including homes that can withstand vibration and earth movement caused by earthquakes. The construction system can use corrugated steel pipes to create floor framing, wall framing, and ceiling framing that is resistant to destruction caused by earth movement and vibrations. The floor framing and wall framing can be connected together at right angles and supported by a foundation that features wood pilings with concrete caps. The concrete caps can include rubber pads mounted on their top surfaces to which the pipes of the floor frame and wall frame can be secured. The concrete caps of the pilings can also feature embedded steel straps to which steel strappings can be attached to secure the pipes of the floor frame to the foundation. The plurality of pipes of the floor framing, wall framing, and ceiling framing can be connected together by welding, screws, or other fasteners to assemble the structure. Finished floor, material, and ceiling materials can be fastened to the frames to complete the structure.

The construction systems and methods of the invention are advantageous because they provide a quick, efficient, inexpensive and sturdy means of constructing houses and other building structures that can withstand the vibrations and earth movement produced by earthquakes.

Accordingly, the invention features a construction system that can include a floor frame, a wall frame, and a ceiling frame. At least one of the floor frame, the wall frame, and the ceiling frame can be constructed from a plurality of pipes fastened together to create a building structure.

In another aspect, the invention can feature the floor frame being a plurality of pipes fastened together.

In another aspect, the invention can feature the wall frame being a plurality of pipes fastened together.

In another aspect, the invention can feature the ceiling frame being a plurality of pipes fastened together.

In another aspect, the invention can feature the plurality of pipes being corrugated pipes.

In another aspect, the invention can feature the plurality of pipes being corrugated steel pipes.

In another aspect, the invention can feature the wall frame pipes being attached at a bottom portion to the floor frame pipes at right angles and being attached at a top portion to the ceiling frame pipes at right angles.

In another aspect, the invention can feature the building structure including a foundation featuring a plurality of pilings to which the floor frame is secured.

In another aspect, the invention can feature each piling including a wooden pile featuring a top portion set into a concrete cap and a bottom portion suspended beneath the concrete cap that is installable in a substrate.

In another aspect, the invention can feature the concrete cap of each piling including reinforcing internal steel rebar.

In another aspect, the invention can feature the concrete cap of each piling including a rubber pad installed on its top surface.

In another aspect, the invention can feature at least one pipe of the floor frame being secured to the rubber pad installed on the concrete cap's top surface.

In another aspect, the invention can feature at least one pipe of the wall frame being secured to the rubber pad installed on the concrete cap's top surface.

In another aspect, the invention can feature each concrete cap including at least one steel strap embedded therein.

In another aspect, the invention can feature the steel strap being sized and shaped to receive a pipe of the floor frame to secure the floor frame to the foundation.

In another aspect, the invention can feature a floor including at least one corrugated metal sheet being fastened to a top surface of the floor frame.

In another aspect, the invention can feature a plurality of exterior walls of the building structure being attached to the wall frame. Each exterior wall can feature at least one corrugated metal sheet.

In another aspect, the invention can feature a plurality of trusses covered by a plurality of metal roof sheets being secured to the ceiling frame.

In another aspect, the invention can feature the plurality of pipes being welded together at joints.

A method of the invention can be used to construct a building structure that is resistant to damage and destruction caused by vibrations and earth movement caused by earthquakes. The method can include the steps of: (a) assembling a plurality of floor pipes to create a floor frame; (b) securing the floor frame to a foundation featuring a plurality of pilings embedded in a substrate; (c) assembling a plurality of wall pipes to create a wall frame; (d) securing the wall frame to the foundation and to the floor frame; (e) assembling a plurality of ceiling pipes to create a ceiling frame; (f) securing the ceiling frame to the wall frame; and (g) securing a floor to the floor frame, securing interior and exterior walls to the wall frame, and securing a ceiling and roof to the ceiling frame to create a building structure.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
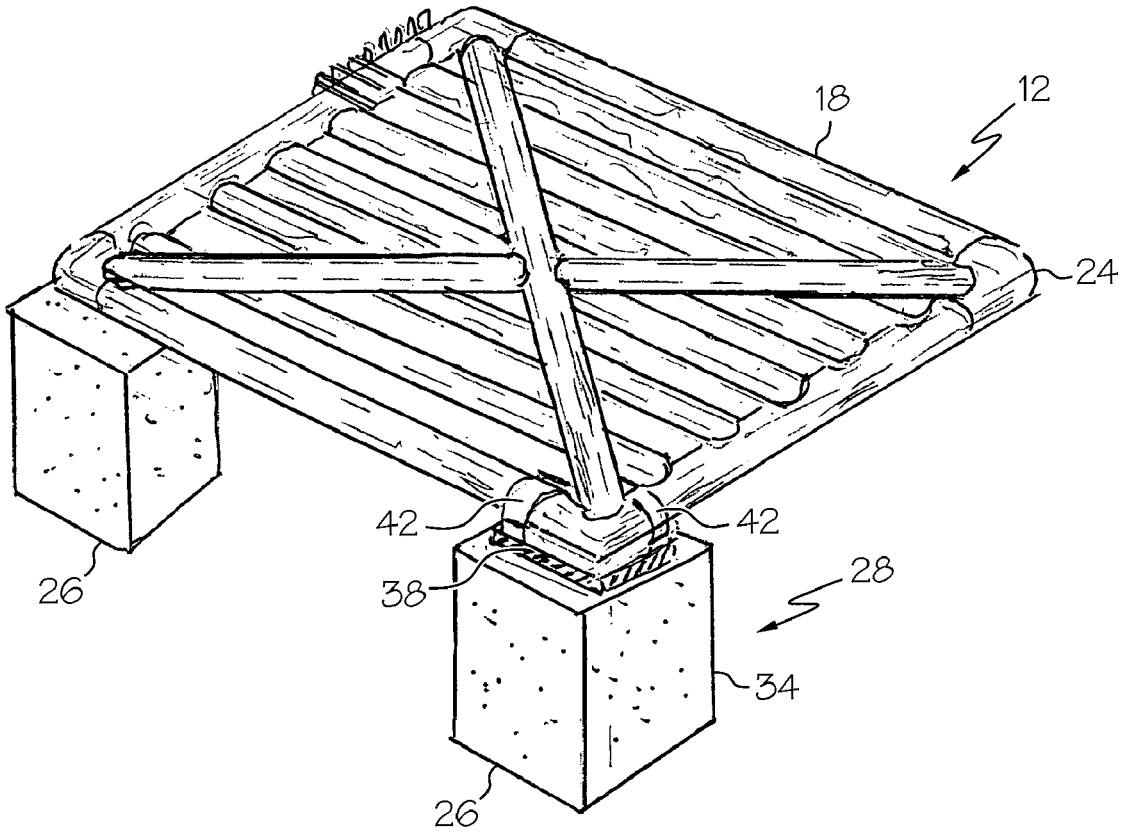
FIG. 1 is a perspective view of one embodiment of first floor framing of the invention.
Figure 2:
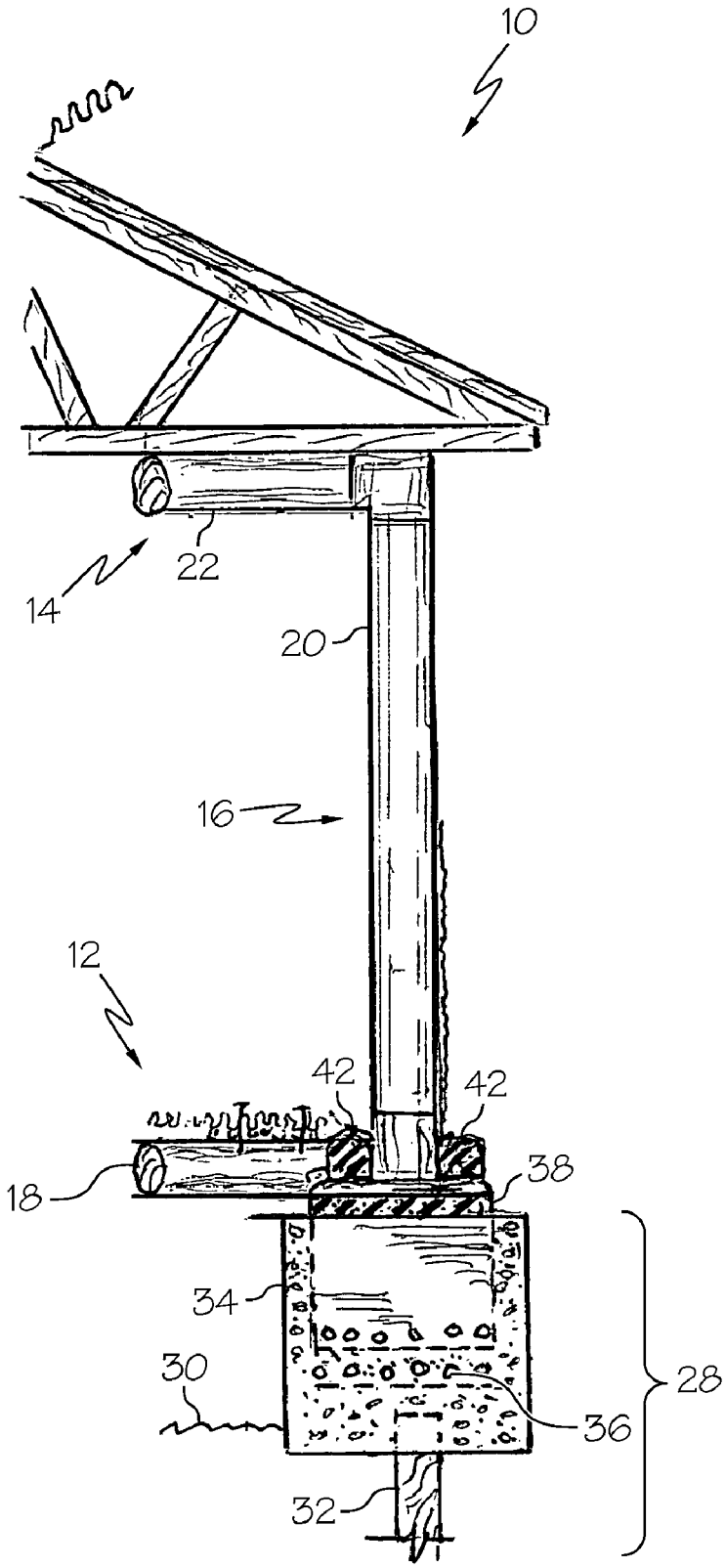
FIG. 2 is a side view of framing section of the invention with a piling shown in cross-sectional view.

The invention provides a home construction 10 that is resistant to damage caused by earth movement such as earthquakes. The home construction 10 can include a floor framing 12, a ceiling framing 14, and wall framing 16 disposed and interconnected between the floor framing and the ceiling framing. Framing is also referred to herein as a frame. As shown in FIGS. 1 and 2, the floor framing 12, wall framing 16, and ceiling framing 14 can be constructed from a plurality of pipes 18, 20, and 22, respectively. The wall pipes 20 can be connected to the floor and ceiling pipes 18 and 22 at right angles. These components can be assembled together to create a building structure such as, for example, a house.

The pipes 18, 20, and 22 can be corrugated steel pipes. The pipes can also be constructed from galvanized steel and may be round in cross-section. In an exemplary embodiment, each pipe can be about 8 inches in diameter. In an exemplary embodiment, the pipes can be about 8 feet in length. The pipes can be constructed from 12 or 14 gauge steel. The pipes can be of the type that are used in water drainage.

The floor framing pipes 18 can be assembled into a desired shape. For example, as shown in FIG. 1, the floor framing pipes 18 can be assembled to form a floor frame 12 in the shape of a square. Joints 24 where two or more pipes of the floor framing join can be welded together. One or more corrugated steel sheets can be connected by screws or other fasteners to a top surface of the floor framing. A flooring material can be attached to a top surface of the corrugated steel sheets. In an exemplary embodiment, ⅝-inch plywood can be connected to the top surface of the corrugated steel sheets. Carpet or any other flooring can be installed over a top surface of the plywood.

A foundation 26 can be constructed from piles (or pilings) 28. The floor framing 12 can be installed to rest upon the piles 28, which are positioned on a substrate 30. In an exemplary embodiment, each pile 28 can include a wooden portion 32 with a concrete cap 34. The substrate 30 can be sand or any other substrate. The concrete cap 34 of each pile 28 can include reinforcing internal steel rebar 36 that is oriented in two directions, e.g., the rebar can be oriented within each concrete pile so that a first set of the rebar is oriented in a perpendicular orientation to a second set of the rebar. The rebar 36 can be ½-inch steel rebar. The wooden portion 32 of each pile can be about 6 inches in diameter and can be spaced apart about 6 feet on center and extend vertically from the bottom of each concrete cap 34. In one embodiment, the concrete cap 34 of each pile 28 can be about 4 feet by 4 feet in width and about 3 feet in height.

Figure 3:
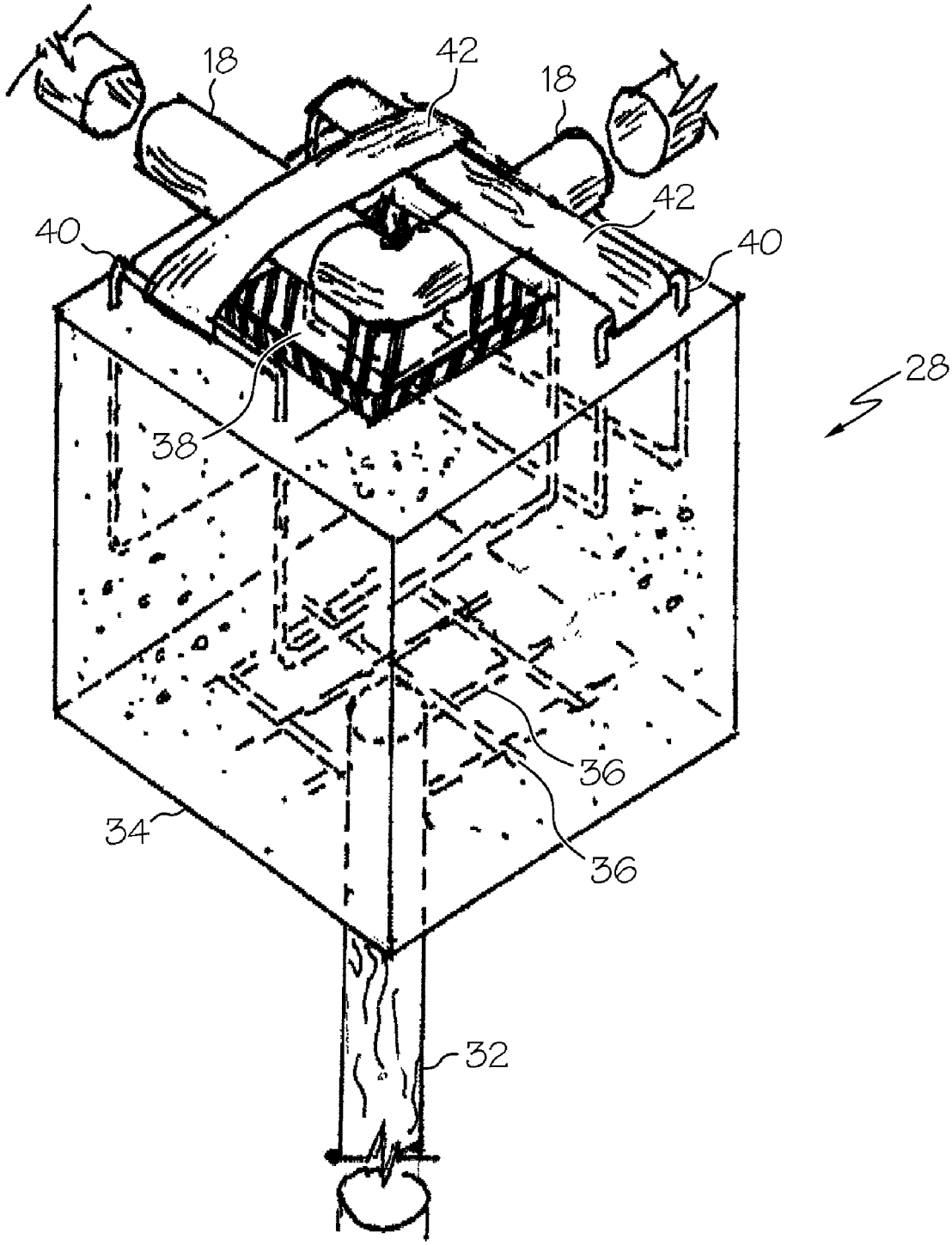
FIG. 3 is a perspective view of a piling to which floor pipes are secured with structures inside a concrete cap of the piling shown in partial phantom view.

In an exemplary embodiment shown in FIG. 3, one or more steel straps 40 can be embedded in the concrete of each pile's concrete cap 34. The steel straps 40 can be used to secure the floor pipes 18 to the piles 28. A rubber pad 38 can also be installed between each floor pipe 18 and the concrete pile cap 34. The rubber pad 38 can be about 2 inches thick.

In another embodiment, at least one steel strapping 42 can be connected to each steel strap 40. The steel strapping 42 can be attached around pipes 18 of the floor framing 12 to secure the pipes 18 to the piles 28.

The wall framing 16 can feature a plurality of pipes 20 connected perpendicularly to the floor framing and to the concrete piles 28. Each wall frame pipe 20 can be positioned on a top surface of the rubber pad 38 mounted on top of the concrete piles 28. The wall frame pipes 20 can be spaced apart about 16 inches on center in a vertical position for all outside walls. The finished exterior walls can have corrugated aluminum vertical siding fastened by screws or other suitable fasteners to the wall frame pipes.

All interior partitions or walls of the structure can be standard 4-inch steel studs. The steel studs can be about 8 feet high and spaced apart about 16 inches on center. Sheetrock, e.g., ½-inch sheetrock, can be fastened using screws or other suitable fasteners to the interior walls and ceiling of the structure.

The pipes 18, 20, and 22 used with this invention can include any of various types of connections such as, for example, corner joints, three-way connections, and any other suitable type of connection or joint. The joints or other connections between two or more pipes can be welded or screwed together. In exemplary embodiments, the joints 24 and other connections between pipes are welded together. Odd angle connections can be welded in the field when the frames are being assembled. In an exemplary embodiment, all pipe welds can be painted to prevent rust.

The plurality of pipes 22 of the ceiling framing 14 can also be spaced apart horizontally about 16 inches on center. A roof framing that is connected to the ceiling framing 14 can be constructed from 2-inch by 4-inch steel trusses that span the structure's exterior walls. The steel trusses can be spaced apart about 16 inches on center and can include corrugated aluminum roofing sheets fastened in place by screws or other suitable fasteners. The structure's exterior walls and ceilings can be insulated with insulation materials such as, for example, 4-inch batt insulation.

The invention also features methods in which the components described herein can be used to construct a building structure that is resistant to damage and destruction caused by vibrations and earth movement caused by earthquakes. The method can include the steps of assembling a plurality of floor pipes to create a floor frame and securing the floor frame to a foundation featuring a plurality of pilings embedded in a substrate. The method also features the steps of assembling a plurality of wall pipes to create a wall frame and securing the wall frame to the foundation and to the floor frame. The method can further include the steps of assembling a plurality of ceiling pipes to create a ceiling frame and securing the ceiling frame to the wall frame. Finally, the method can also include the step of securing a floor to the floor frame, securing interior and exterior walls to the wall frame, and securing a ceiling and roof to the ceiling frame to create a building structure.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A construction system comprising:

a floor frame;

a wall flame; and a ceiling frame, wherein at least one of the floor flame, the wall flame, and the ceiling frame comprises a plurality of pipes fastened together to create a building structure;

wherein the building structure comprises a foundation comprising a plurality of pilings to which the floor frame is secured;

wherein each piling comprises a wooden pile comprising a top portion set into a concrete cap and a bottom portion suspended beneath the concrete cap that is installable in a substrate;

wherein each concrete cap comprises at least one steel strap embedded therein;

the steel strap is sized and shaped to receive a pipe of the floor frame to secure the floor frame to the foundation.

2. The construction system of claim 1, wherein the floor frame comprises the plurality of pipes fastened together.

3. The construction system of claim 1, wherein the wall frame comprises the plurality of pipes fastened together.

4. The construction system of claim 1, wherein the ceiling frame comprises the plurality of pipes fastened together.

5. The construction system of claim 1, wherein the plurality of pipes comprise corrugated pipes.

6. The construction system of claim 1, wherein the plurality of pipes comprise corrugated steel pipes.

7. The construction system of claim 1, wherein the wall frame pipes are attached at a bottom portion to the floor frame pipes at right angles and are attached at a top portion to the ceiling frame pipes at right angles.

8. The construction system of claim 1, wherein the concrete cap of each piling comprises reinforcing internal steel rebar.

9. The construction system of claim 1, wherein the concrete cap of each piling comprises a rubber pad installed on its top surface.

10. The construction system of claim 9, wherein at least one pipe of the floor frame is secured to the rubber pad installed on the concrete cap's top surface.

11. The construction system of claim 9, wherein at least one pipe of the wall frame is secured to the rubber pad installed on the concrete cap's top surface.

12. The construction system of claim 1, wherein a floor comprised of at least one corrugated metal sheet is fastened to a top surface of the floor frame.

13. The construction system of claim 1, wherein a plurality of exterior walls of the building structure are attached to the wall frame, wherein each exterior wall comprises at least one corrugated metal sheet.

14. The construction system of claim 1, wherein a plurality of trusses covered by a plurality of metal roof sheets are secured to the ceiling frame.

15. The construction system of claim 1, wherein the plurality of pipes are welded together at joints.

16. A method for constructing a building structure that is resistant to damage and destruction caused by vibrations and earth movement caused by earthquakes, wherein the method comprises the steps of:

(a) assembling a plurality of floor pipes to create a floor frame;

(b) securing the floor frame to a foundation comprising a plurality of pilings embedded in a substrate, each said piling comprises a wooden pile comprising a top portion set into a concrete cap and a bottom portion suspended beneath the concrete cap that is installed in the substrate, each concrete cap comprises at least one steel strap embedded therein, the at least one steel strap receiving a pipe of the floor frame to secure the floor frame to the foundation;

(c) assembling a plurality of wall pipes to create a wall frame;

(d) securing the wall frame to the foundation and to the floor frame; (e) assembling a plurality of ceiling pipes to create a ceiling frame; (f) securing the ceiling frame to the wall frame; and (g) securing a floor to the floor frame, securing interior and exterior walls to the wall frame, and securing a ceiling and roof to the ceiling frame to create a building structure.

* * * * *